US006095898A

United States Patent [19]

Hennhöfer et al.

[11] Patent Number: 6,095,898

[45] Date of Patent: Aug. 1, 2000

[54] PROCESS AND DEVICE FOR POLISHING SEMICONDUCTOR WAFERS

[75] Inventors: Heinrich Hennhöfer, Alötting; Hans Krämer, Burghausen; Helmut Kirschner, Emmerting, all of Germany; Manfred Thurner, Ach, Austria; Thomas Buschhardt, Burghausen; Klaus Röttger, Schnaitsee, both of Germany

[73] Assignee: Wacker Siltronic Gesellschaft für Halbleitermaterialien AG, Burghausen, Germany

[21] Appl. No.: 09/181,428

[22] Filed: Oct. 28, 1998

[30] Foreign Application Priority Data

Oct. 30, 1997 [DE] Germany ..... 197 48 020

[51] Int. Cl.[7] ..... B24B 49/14; B24B 1/00

[52] U.S. Cl. ..... 451/7; 451/5; 451/8; 451/41; 451/53

[58] Field of Search ..... 451/5, 7, 8, 4, 451/53, 59, 63

[56] References Cited

U.S. PATENT DOCUMENTS 4,270,316 6/1981 Krämer et al. .
4,471,579 9/1984 Bovensiepen .
5,036,630 8/1991 Kaanta et al. .
5,718,620 2/1998 Tanaka et al. ..... 451/288
5,873,769 2/1999 Chiou et al. ..... 451/7

FOREIGN PATENT DOCUMENTS 0004033 3/1979 European Pat. Off. .
0562718 9/1993 European Pat. Off. .

OTHER PUBLICATIONS

Patent Abstracts of Japan, vol. 010, No. 051 (H–457), Feb. 28, 1986, & JP 60 201868 A (Hitachi Seisakado KK), Oct. 12, 1985.

*Primary Examiner*—Timothy V. Eley
*Attorney, Agent, or Firm*—Collard & Roe, P.C.

[57] ABSTRACT

A process and device for polishing semiconductor wafers has at least one side of at least one semiconductor wafer pressed against a polishing plate, over which a polishing cloth is stretched. The semiconductor wafer and the polishing plate are moved relative to each other to polish the wafer. During the polishing, the semiconductor wafer passes over at least two regions on the polishing plate, which regions have defined radial widths and are at different temperatures. Temperature-control means are provided in the polishing plate, with the aid of which the number, the radial widths and the temperatures of the regions are fixed before the semiconductor wafers are polished.

10 Claims, 3 Drawing Sheets

PROCESS AND DEVICE FOR POLISHING SEMICONDUCTOR WAFERS

BACKGROUND OF THE INVENTION

1. Field of the Invention

The invention relates to a process for polishing semiconductor wafers. At least one side of at least one semiconductor wafer is pressed against a polishing plate, over which a polishing cloth is stretched. Thus at least one side is polished, while the semiconductor wafer and the polishing plate move relative to each other. The invention also relates to a device which is suitable for carrying out the process.

2. The Prior Art

Making a semiconductor wafer planar by means of a chemo-mechanical polishing process represents an important processing step in the process sequence for producing a planar, flawless and smooth semiconductor wafer. In many manufacturing sequences, this polishing step represents the last shaping step. Therefore this step decisively determines the surface properties, before the semiconductor wafer is further used. For example the wafer may be used as starting material for the production of electrical, electronic and microelectronic components. The objectives of the polishing process are to achieve a high planarity and parallelism of the two sides of the wafer, and to remove surface layers which have been damaged by pretreatments ("damage removal"). An additional objective is to reduce the microroughness of the semiconductor wafer.

Single side polishing processes and double side polishing processes are generally used. In the case of single side polishing of a batch of semiconductor wafers ("single side batch polishing"), one side of the semiconductor wafers is mounted on the front side of a carrier plate. This is accomplished by producing a form-fitting and force-fitting connection between the side of the wafer and the carrier plate. This connection can be by adhesion, bonding, cementing or the application of vacuum. As a rule, the semiconductor wafers are mounted on the carrier plate in such a way that they form a pattern of concentric rings. After having been mounted, the free sides of the wafers are pressed against a polishing plate, over which a polishing cloth is stretched. This pressing is with a defined polishing force and with a supplied polishing abrasive, such that these sides are then polished. In the process, the carrier plate and the polishing plate are usually rotated at different speeds. The polishing force required is transmitted to the rear side of the carrier plate by a pressure piston, or polishing head. A large number of the polishing machines used are designed in such a way that they have a plurality of polishing heads. Accordingly, they are able to accommodate a plurality of carrier plates.

In double side polishing (DSP), the front side and the rear side of the wafers are polished simultaneously. Thus a plurality of semiconductor wafers are guided between two, an upper and a lower, polishing plates over which polishing cloths are stretched. In this embodiment, the semiconductor wafers lie in thin wafer carriers. These carriers are referred to as rotor disks and are also used in a similar form during lapping of semiconductor wafers. Double side polishing processes and devices are always designed for treating groups of semiconductor wafers ("batch polishing").

A plurality of factors make it difficult to achieve the desired planarity and parallelism of the semiconductor wafers, referred to below as the desired geometry. Polished semiconductor wafers often have sides which are not parallel to one another, but rather have the cross-sectional shape of a wedge.

The shape of the wedge can be described using the term "linear thickness variation." The linear thickness variation is the largest measured difference in thickness between two measurement points which lie on the same diameter, symmetrically with respect to the center of the semiconductor wafer. Usually, the measurement points lie symmetrically on a circle which is at a distance of, for example, 6 mm from the edge of the semiconductor wafer. If the edge of the semiconductor wafer which faces toward the edge of the carrier plate is thicker (thinner) than the wafer edge which faces toward the center of the carrier plate, this is known as a positive (negative) linear wedge shape.

Another measurement of the wedge shape of semiconductor wafers is the so-called TTV value (TTV=total thickness variation). This value gives the difference between the thickest and thinnest points on the semiconductor wafer.

A semiconductor wafer wedge shape caused by the polishing is ultimately the result of uneven removal of material. This may arise if the carrier plate is deformed radially during polishing as a result of its own weight or has a certain radial wedge shape caused by its production. Sometimes, incipient wear to the polishing cloth is also a cause of the wafer geometry deteriorating during a number of polishing runs. A certain fundamental wedge shape results even when using carrier plates which are of ideal planarity. This may result from the kinematic ratios during single side (wafer) polishing, which require inhomogeneous removal of material.

EP-4033 A1 discloses inserting interlayers of soft, elastic bodies between the polishing head and the rear side of the carrier plate. This has the result that the carrier plate is deliberately curved slightly in a radially symmetrical manner. In this way, it is partially possible, to prevent the semiconductor wafers from being polished into a wedge. However, this process cannot be automated and is susceptible to failure. This is because its success depends on the experience of and the care taken by the operating personnel. These personnel have to select and insert the interlayers on the basis of their width. However, even if no mistakes are made in doing this, the wedge shape of the polished semiconductor wafers remains above a defined limit value.

SUMMARY OF THE INVENTION

It is an object of the present invention to improve the uniformity of polishing abrasion when polishing semiconductor wafers, so that the wedge shape of the polished semiconductor wafers is minimized.

The above object is achieved by the present invention which provides a process for polishing semiconductor wafers, in which at least one side of at least one semiconductor wafer is pressed against a polishing plate, over which a polishing cloth is stretched, and is polished. The semiconductor wafer and the polishing plate move relative to each other. The semiconductor wafer passes over at least two regions on the polishing plate during the polishing step. These regions each have a defined radial width and are at different temperatures. Temperature-control means are provided in the polishing plate, with the aid of which the number, the radial widths and the temperatures of the regions are fixed before the semiconductor wafers are polished.

The present invention furthermore provides a device for carrying out the process, which has a chamber system, which is accommodated in the polishing plate, comprising concentrically arranged annular chambers through which a temperature-control medium flows. Temperature control means assures that the temperature control medium is at a defined, adjustable temperature in each annular chamber.

According to the invention it has been found that during polishing a radially convex temperature profile is established on the polishing plate. This temperature profile is partly responsible for the wedge shape of polished semiconductor wafers. The temperature profile causes an inhomogeneous removal of material. This cannot be corrected, for example, by using ceramic carrier plates, which cannot be curved. Also this wedge shape cannot be compensated for sufficiently when using carrier plates made from less rigid material such as the abovementioned elastic interlayers.

The present invention provides this compensation. This is because the creation of temperature-controlled regions provides a radial temperature profile for the polishing plate which is decisive in determining the amount of material removed. The invention permits the wedge shape of semiconductor wafers to be set within comparatively wide limits by polishing. By means of the invention, it is possible to produce semiconductor wafers which have a controlled positive or negative wedge shape. However, the invention is primarily used to compensate for kinematic effects. The invention compensates for the effects of the carrier plate or of the polishing cloth which would lead to wedge shapes. The present invention is also useful to extend the service life of the polishing cloth.

The invention can be used both for single side polishing (single-wafer and batch polishing) and for double side polishing. The invention is explained in more detail below with reference to the example of single side batch polishing.

According to the invention, the semiconductor wafers pass over at least two regions on the polishing plate during polishing. These regions are maintained at certain temperatures by temperature-control means in the polishing plate. The regions are preferably positioned in concentric rings, with the temperatures of at least two of the regions differing. The number, the radial widths and the temperatures of the regions are determined before a polishing run. It is possible to change the temperatures at which the regions are held during a polishing run.

Due to effects of polishing kinematics, carrier plates are used which are not completely planar and cause inhomogeneous wear to the polishing cloth. On a conventional polishing plate the temperature is not homogeneous during polishing of semiconductor wafers. The temperature often increases from the edge to r/2 of the polishing plate (r being the radius of the polishing plate) and falls toward the center of the polishing plate. The result is a radially convex temperature profile. By establishing regions on the polishing plate which can be held at certain temperatures by temperature-control means accommodated in the polishing plate, it is possible to homogenize the temperature profile. In order to avoid the formation of a radially convex temperature profile, at least two temperature-controlled regions should be established on the polishing plate.

In another embodiment there are three regions in the form of concentric rings, the outer and inner regions being held at a higher temperature than the middle region. As a result, heat which is generated in the central region of the polishing plate during polishing of semiconductor wafers is dissipated via the temperature-control means. The outer and inner ring, and hence those parts of the polishing plate which are close to the edge, by contrast, receive additional thermal energy. Thus a flatter radial temperature profile is the overall result. in principle, the invention can be used to level out any desired radial temperature profile which occurs during polishing.

The number of regions, their radial width and the temperatures at which they are held are fixed before the semiconductor wafers are polished. Data from analyzing the geometry of previously polished semiconductor wafers can be used. For example, the linear thickness variation determined for these semiconductor wafers, can be used as a basis for fixing the above factors. Measured data relating to the radial temperature profile of the polishing plate which were determined during a preceding polishing run may also be used as a basis.

The functional connection between the semiconductor wafer geometry after a polishing and the number, width and temperatures of the polishing plate regions which are to be fixed is determined by routine experiments. In such experiments, the number, radial width and temperatures of the regions are systematically changed. The effects on the geometry of the polished semiconductor wafers are then investigated.

After concluding such experiments, the polishing process can be automated in a simple manner. A master computer receives, as input data, the radial temperature profile which was determined during a preceding polishing run. This computer also receives data relating to the geometry (for example to the wedge shape) of semiconductor waters which were polished during a preceding polishing run. On the basis of the empirically discovered relationship, the master computer then fixes the parameters required to achieve a desired wafer geometry. These parameters include the number, radial width and temperature of the regions.

BRIEF DESCRIPTION OF THE DRAWINGS

Other objects and features of the present invention will become apparent from the following detailed description considered in connection with the accompanying drawings which discloses several embodiments of the present invention. It should be understood, however, that the drawings are designed for the purposes of illustration only and not as a definition of the limits of the invention.

In the drawings, wherein similar reference characters denote similar elements throughout the several views.

DETAILED DESCRIPTION OF PREFERRED EMBODIMENTS

Figure 1:
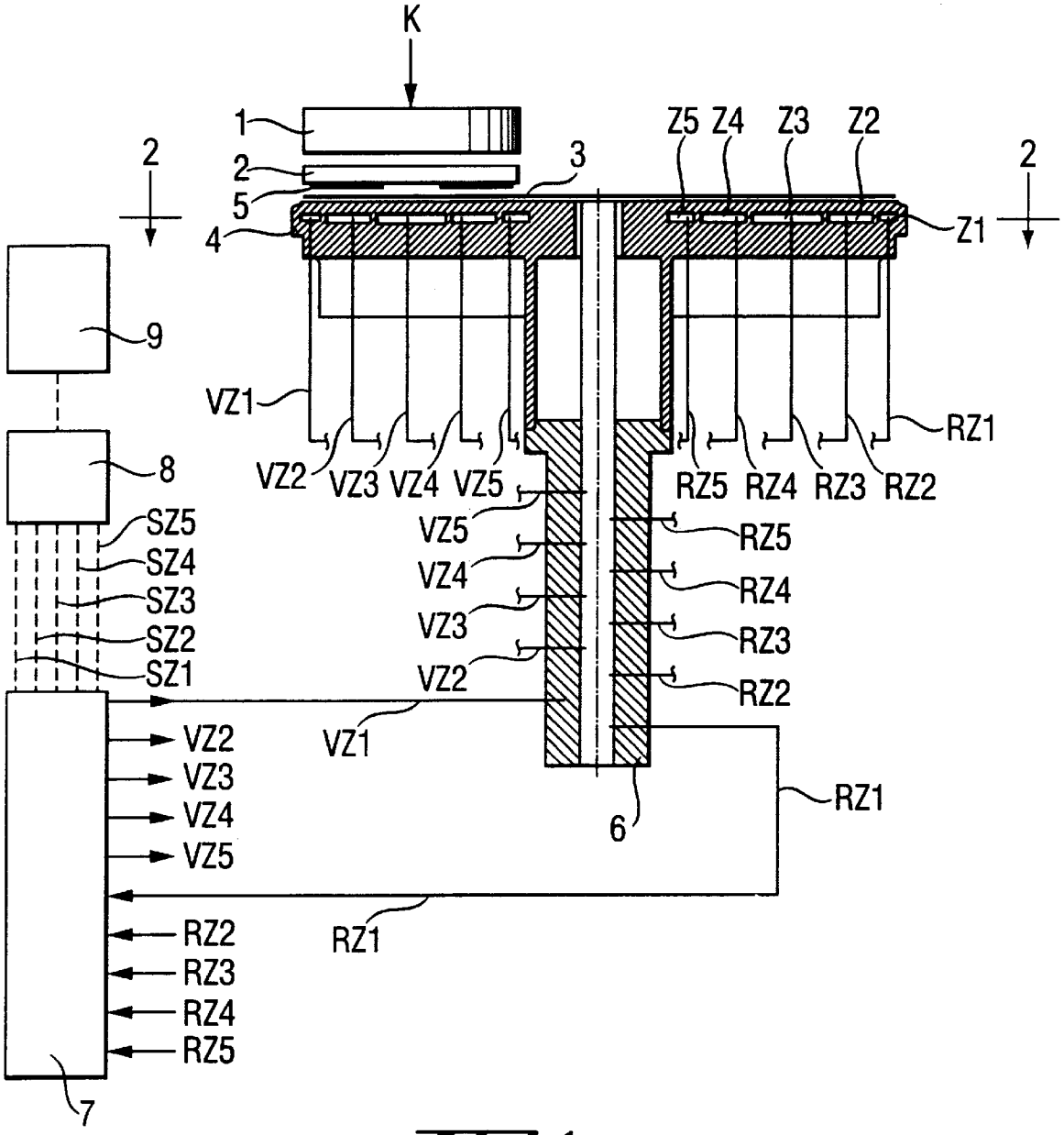
FIG. 1 diagrammatically shows a side view of a vertical section through the device of the invention.

Turning now in detail to the drawings, FIG. 1 shows a single side polishing machine with a plurality of polishing heads, one of which can be seen. The polishing head 1 presses a carrier plate 2 with a polishing force K against a polishing plate 4 over which a polishing cloth 3 is stretched. The carrier plate is held on the polishing head by means of vacuum suction, for example. The semiconductor wafers 5 are fixed on the front side, facing toward the polishing cloth 3, of the carrier plate 2. During polishing, both the carrier plate and the polishing plate rotate at a certain speed and with a certain direction of rotation.

The essential features of the device are annular chambers in the polishing plate which are in concentrically arranged locations and through which a temperature-control medium flows. In the polishing plate illustrated, five annular chambers Z1 to Z5 are provided. Each annular chamber, independently of any other, has a temperature-control medium, for example water, flowing through it. The temperature-control medium is at a specific temperature in each annular chamber, and it is possible for the temperatures to differ. The temperature-control medium is pumped into the respective annular chambers through flow lines VZ1 to VZ5 and leaves these chambers again through return lines RZ1 to RZ5. The flow and return lines run through a rotary leadthrough 6 which is attached to the underside of the polishing plate 4. For reasons of clarity, the flow and return lines are illustrated in an interrupted manner. The temperature-control medium is held at a desired temperature by a thermostat device 7. The thermostat device is controlled by a master computer 8 which prescribes the desired temperatures SZ1 to SZ5 for the temperature-control medium in the annular chambers Z1 to Z5. The master computer for its part accesses a memory 9 in which measured data from preceding polishing runs are stored and, from these, automatically calculates the desired temperatures.

The temperature-control medium maintains a defined temperature in each annular chamber, so that radially symmetrical regions of characteristic temperature are formed on the polishing plate. The semiconductor wafers pass over these regions during polishing. The number of available regions depends on the number of annular chambers provided. The radial widths of the regions are dependent on the selected radial widths of the annular chambers and on the temperature of the temperature-control medium which flows through the annular chambers.

Figure 2:
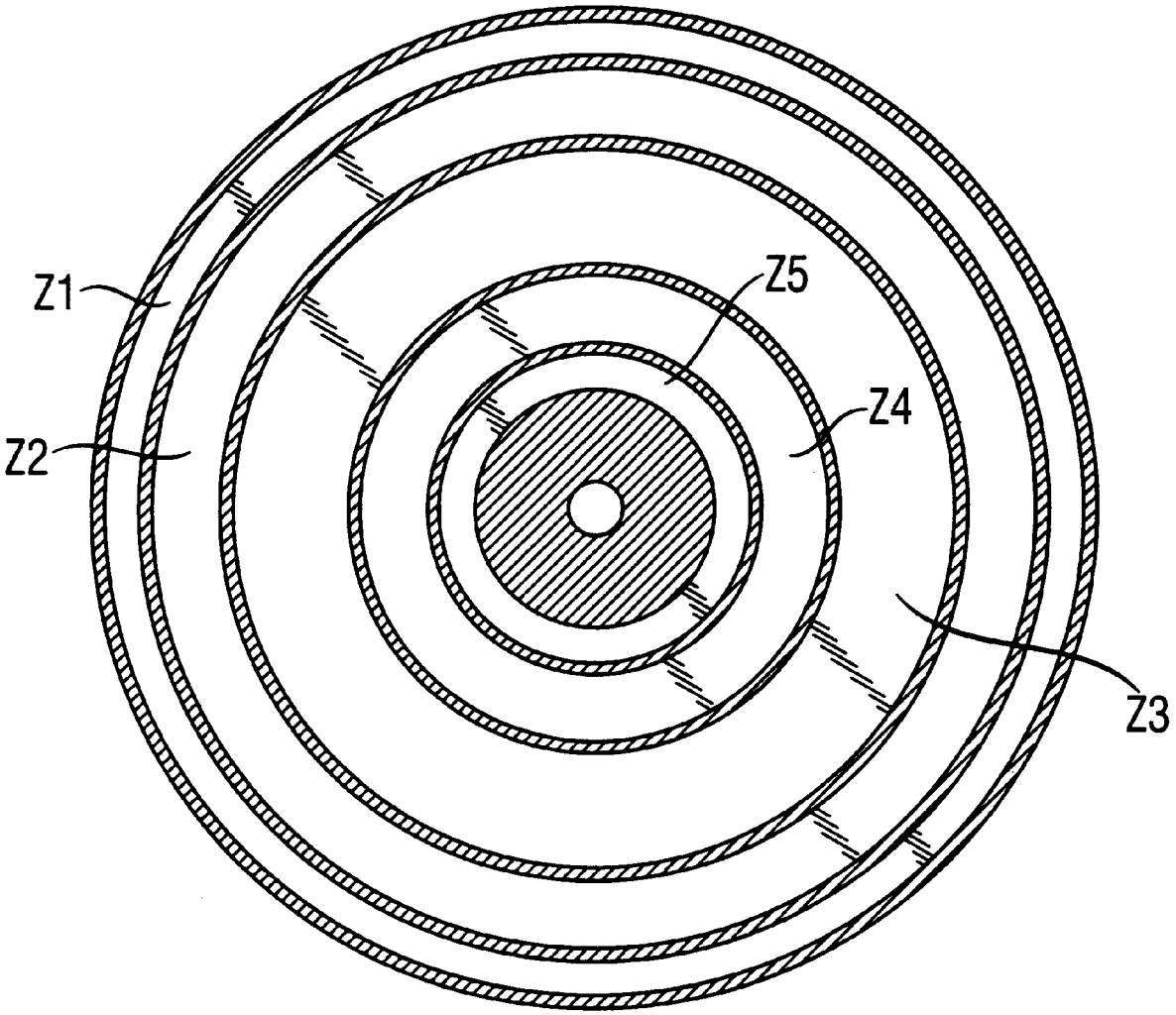
FIG. 2 shows a plan view of a horizontal section along line 2—2 of FIG. 1 through the polishing plate of the device of FIG. 1.

FIG. 2 illustrates a horizontal section along line 2—2 of FIG. 1 through the polishing plate 4 of the device in accordance with FIG. 1. The temperature of the temperature-control medium can differ in each annular chamber Z1 to Z5 from the temperatures of the temperature-control medium in the other annular chambers. Thus the annular chambers form a number of annular regions on the polishing plate which corresponds to the number of annular chambers. These regions are kept at a temperature which essentially corresponds to the temperature of the temperature-control medium in the associated annular chamber. The number of regions is correspondingly lower if the temperature of the temperature-control medium in two or more adjacent annular chambers is identical. It is possible that the temperature of the temperature-control medium is identical in two adjacent annular chambers. This results in a region on the polishing plate with a radial width which approximately corresponds to the sum of the radial widths of these annular chambers. Preferably, 2 to 5 annular chambers are provided. The radial widths of the annular chambers preferably amount to 25% to 120% of the diameter of the semiconductor wafers to be polished In an alternative embodiment to the one shown in FIG. 2, the annular chambers may also be differently structured for example, in meandering form. It is also possible to set a defined radial temperature profile on the polishing plate by providing regions of a specific temperature in other ways from that described above. For example, this is possible by integrating heating elements and cooling elements in the polishing plate. These elements may be operated by induction or by a power supply which is also accommodated in the polishing plate.

FIGS. 3*a*, 3*b* and 4*a*, 4*b* diagrammatically illustrate how the geometry of semiconductor wafers can be influenced by employing the invention.

Figure 3A:
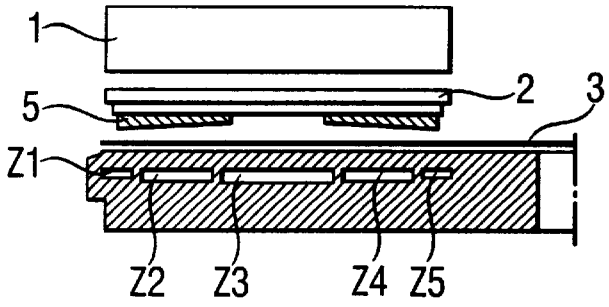
FIG. 3*a* shows how the geometry of wedge-shaped semiconductor wafers can be corrected in FIG. 3*b* using the device of the invention to produce wafers with parallel surfaces.
Figure 3B:
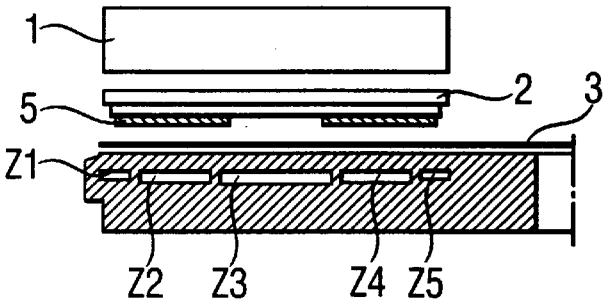

After a polishing run using the device shown in FIG. 1, semiconductor wafers with a positive wedge shape were obtained. During the polishing run, temperature-control medium flowed through the annular chambers with its temperature in the annular chambers Z1 to Z5 controlled in the following way: Z1=30° C., Z2=30° C., Z3=40° C., Z4=30° C. and Z5=30° C. (FIG. 3*a*). By changing the temperatures in the annular chambers (Z1=40° C., Z2=40° C., Z3=30° C., Z4=40° C. and Z5=40° C.) it was possible, after a following polishing run, to obtain semiconductor wafers with plane-parallel sides (FIG. 3*b*).

Figure 4A:
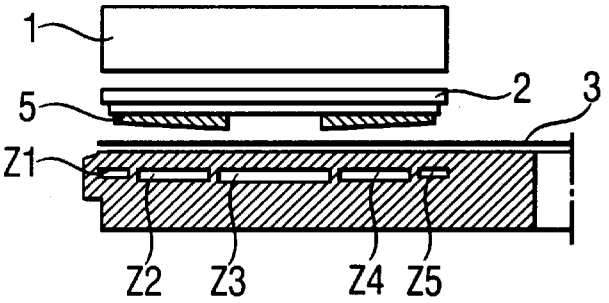
FIG. 4*a* shows how the geometry of wedge-shaped semiconductor wafers can be corrected in FIG. 4*b* using the device of the invention to produce wafers with parallel surfaces.
Figure 4B:
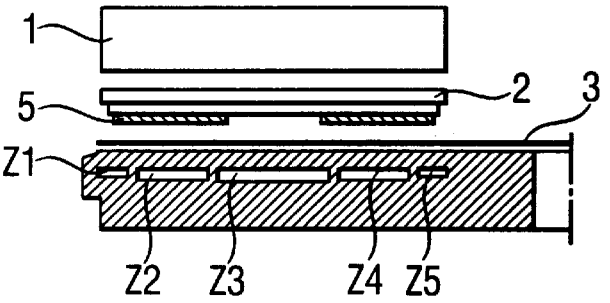

After a polishing run using the device shown in FIG. 1, semiconductor wafers with a negative wedge shape were obtained. During the polishing run, temperature-control medium flowed through the annular chambers, with its temperature in the annular chambers Z1 to Z5 controlled in the following way: Z1=30° C., Z2=30° C., Z3=40° C., Z4=30° C. and Z5=30° C. (FIG. 4*a*). By changing the temperatures in the annular chambers (Z1=20° C., Z2=20° C., Z3=50° C., Z4=20° C. and Z5=20° C.) it was possible, after a following polishing run, again to obtain semiconductor wafers with plane-parallel sides (FIG. 4*b*).

While a few embodiments of the present invention have been shown and described, it is to be understood that many changes and modifications may be made thereunto without departing from the spirit and scope of the invention as defined in the appended claims.

What is claimed is:

1. A process for polishing semiconductor wafers, comprising providing a polishing plate and stretching a polishing cloth over said polishing plate;

pressing at least one side of at least one semiconductor wafer against said polishing plate;

moving said polishing plate and said wafer relative to each other and polishing the semiconductor wafer, so that said semiconductor wafer passes over at least two regions on the polishing plate during the polishing; each region having a defined radial width;

providing temperature control means in the polishing plate; said temperature-control means maintaining different temperatures in defined radial widths in the polishing plate;

fixing a number of regions, the radial width of each region and the temperature of each region before said at least one semiconductor wafer is polished;

taking a measurement of a radial temperature profile of the polishing plate; and fixing the number, the radial widths and the temperatures of the regions as a function of the result of said measurement; and carrying out said measurement during a preceding polishing run, of the radial temperature profile of the polishing plate.

2. The process as claimed in claim 1, comprising locating said regions in concentric rings in said polishing plate.

3. The process as claimed in claim 1 comprising automatically fixing the number, the radial widths and the temperatures of the regions by using a computer.

4. The process as claimed in claim 1, comprising changing the temperatures of the regions during the polishing.

5. The process as claimed in claim 1, wherein the polishing is selected from the group consisting of single side wafer polishing, double side wafer polishing, single wafer polishing and batch wafer polishing.

6. A process for polishing semiconductor wafers, comprising providing a polishing plate and stretching a polishing cloth over said polishing plate, pressing at least one side of at least one semiconductor wafer against said polishing plate;

moving said polishing plate and said wafer relative to each other and polishing the semiconductor wafer, so that said semiconductor wafer passes over at least two regions on the polishing plate during the polishing; each region having a defined radial width;

providing temperature control means in the polishing plate; said temperature control means maintaining different temperatures in defined radial widths in the polishing plate;

fixing a number of regions, the radial width of each region and the temperature of each region before said at least one semiconductor wafer is polished;

making an analysis of geometry of previously polished semiconductor wafers; and fixing the number, the radial widths and the temperatures of the regions as a function of said analysis of said geometry of previously polished semiconductor wafers.

7. The process claimed in claim 6, comprising locating said regions in concentric rings in said polishing plate.

8. The process as claimed in claim 6, comprising automatically fixing the number, the radial widths and the temperatures of the regions by using a computer.

9. The process as claimed in claim 6, comprising changing the temperatures of the regions during the polishing.

10. The process as claimed in claim 6, wherein the polishing is selected from the group consisting of single side wafer polishing, double side wafer polishing, single wafer polishing and batch wafer polishing.

* * * * *